United States Patent [19]

Dicker

[11] Patent Number: 4,492,334

[45] Date of Patent: Jan. 8, 1985

[54] TENTLESS CONTINUOUS MAILER ASSEMBLY

[75] Inventor: David Dicker, Scarsdale, N.Y.

[73] Assignee: Transkrit Corporation, Elmsford, N.Y.

[21] Appl. No.: 355,697

[22] Filed: Mar. 8, 1982

[51] Int. Cl.[3] ..... B65D 27/10

[52] U.S. Cl. ..... 229/69; 229/DIG. 4

[58] Field of Search ..... 229/69, DIG. 4; 282/11.5 A, 25

[56] References Cited

U.S. PATENT DOCUMENTS

| | | | |
|---|---|---|---|
| 2,304,523 | 12/1942 | Young | 229/69 |
| 3,482,763 | 12/1969 | Carrigan | 229/69 |
| 3,497,132 | 2/1970 | Henry | 229/69 |
| 3,580,488 | 5/1971 | Komen | 229/69 |
| 3,918,632 | 11/1975 | Neubauer | 229/69 |
| 4,066,206 | 1/1978 | Peterson | 229/69 |
| 4,108,352 | 8/1978 | Peschke | 229/69 |
| 4,361,269 | 11/1982 | Neubauer | 229/69 |

FOREIGN PATENT DOCUMENTS

| | | |
|---|---|---|
| 55509 | 7/1982 | European Pat. Off. . |
| 1273906 | 5/1972 | United Kingdom . |
| 1337902 | 11/1973 | United Kingdom . |
| 1518779 | 7/1978 | United Kingdom . |
| 1522007 | 8/1978 | United Kingdom . |
| 1550739 | 8/1979 | United Kingdom . |
| 1600836 | 10/1981 | United Kingdom . |

*Primary Examiner*—Stephen P. Garbe

*Attorney, Agent, or Firm*—Kenyon & Kenyon

[57] ABSTRACT

The continuous mailer assembly has mailer units in which one of the back or front plies is either completely severed from the adjacent ply or connected to the adjacent ply by a weak hinge connection. In either case, tenting is avoided when the mailer assembly is unfolded from a stacked condition.

9 Claims, 7 Drawing Figures

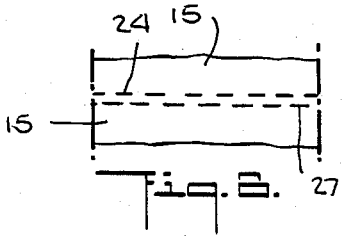
Fig. 8.
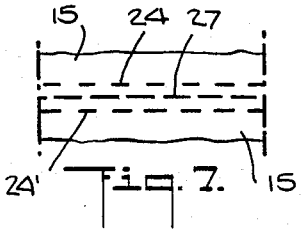
Fig. 7.
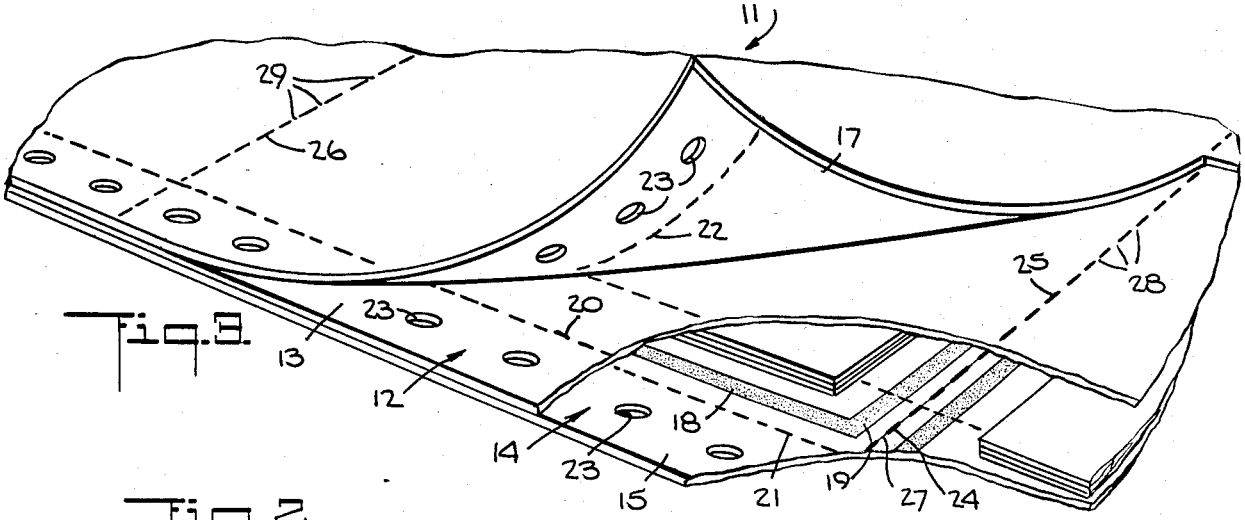
Fig. 9.
Fig. 2.
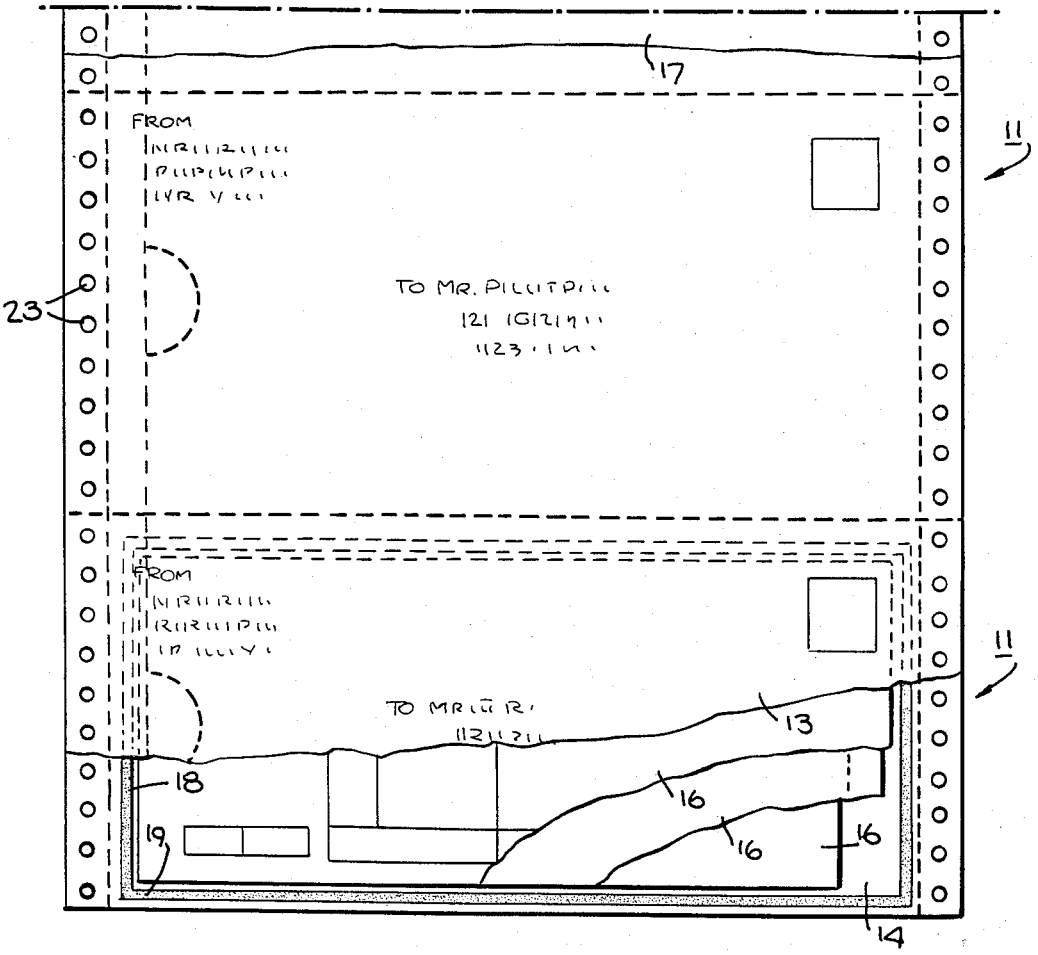

TENTLESS CONTINUOUS MAILER ASSEMBLY

This invention relates to a tentless continuous mailer assembly and a method of fabricating a tentless continuous mailer assembly.

Heretofore, it has been known to manufacture continuous mailer assemblies and similar business forms of multiple plies, such as described in U.S. Pat. Nos. 4,095,695 and 4,108,352, and to fold these assemblies into a stack for shipment purposes. In many cases, when a continuous assembly of this nature is being manufactured, the various plies are brought together and secured to each other via glues or adhesives which set at some point after bringing of the plies together. In some cases, a final set of the adhesive or glue does not take place until some time after the assembly has been folded into a stack. As a result, the set adhesive or glue tends to retain the plies in a fixed condition relative to each other so that when the assembly is folded out from a stack, a peak or "tent" appears at the folds of the assemblies where the various plies are secured together.

"Tenting" presents a problem in the unfolded condition of a continuous assembly of the above type since automated equipment which process the assembly usually have pin wheels which register in pin holes along the side edges of the assembly in order to pass the assembly through the equipment. That is, if a "tent" occurs in the assembly, registration of the pins in the sides of the assembly may not occur. Thus, it is possible for the assembly to lift away from the automatic equipment causing a jamming. Further, "tenting" might cause a pick-up of the edges of the assembly plies about the tent to such an extent that the assembly can be torn by the automated equipment.

In view of the above, various attempts have been made to elimate "tenting" from continuous business forms and assemblies. For example, it has been known from U.S. Pat. No. 4,108,352 to manufacture a business form wherein plies of material are held together via glue and wherein the intermediate plies are completely severed along adjacent edges to eliminate a bend in the intermediate ply at the fold of the assembly. However, the front and back plies have not been completely severed. Thus, the connecting portions between adjacent sections of each of the front and back plies may still cause a tenting effect to occur.

Accordingly, it is an object of the invention to provide a continuous mailer assembly which is able to lay flat without tenting.

It is another object of the invention to provide a simple method of forming a continuous mailer assembly which is able to lay flat without tenting when folded out.

It is another object of the invention to provide a simple technique of fabricating a tentless continuous mailer assembly Briefly, the invention provides a continuous mailer assembly which is comprised of a plurality of interconnected units which can be disposed in stacked array and with each unit including a front ply, a back ply secured to the front ply to define an envelope and at least one insert ply within the envelope. In accordance with the invention, one of the front and back plies of one unit is unconnected with a respective ply of an adjacent unit while the other of the front and back ply of the unit is connected with a similar ply of an adjacent unit in an interrupted manner, e.g. via perforations or the like.

The mailer assembly is constructed so that, for example, with the back plies of adjacent units being unconnected, the assembly can be folded and subsequently unfolded without any tenting occurring between the adjacent units. The connections which remain between the front plies permits hinging of the respective units together in only a single ply. As a result, folding and unfolding of the units can be readily carried out in an unrestrained manner, i.e. without any restraint from the unconnected back plies.

It is to be noted that the front plies may be unconnected with each other while the back plies are connected in an interrupted manner.

In order to fabricate the mailer assembly, at least a pair of paper webs are generated with one of the webs being perforated at longitudinally spaced apart intervals to define a first line of perforations at each interval separating the web into adjacent sections. Thereafter, the webs are superimposed while being adhesively secured to each other within the longitudinally spaced intervals, for example, to form an envelope. Thereafter, the superimposed webs are perforated at longitudinally spaced apart intervals to define a second line of perforations in the previously perforated web offset from and aligned with the first line of perforations such that the two lines of perforations completely sever the adjacent sections. As such, the unconnected sections will not interfere with the folding and unfolding of the mailer assembly into and from a stacked array.

In another embodiment, instead of completely severing a web, a zone can be formed between adjacent web sections which is sufficiently weakened to prevent tenting from occurring upon a subsequent folding and unfolding of the mailer assembly. To this end, the second line of perforations which is formed in the previously perforated web is disposed in parallel offset relation to the first line of perforations to form a weak hinge connection between adjacent sections of the web which is sufficiently weakened to prevent tenting from occurring upon a subsequent folding and unfolding of the adjacent units. Alternatively, the weak hinge connection can be formed by a pair of parallel lines of perforations which are initially formed in one web and a third line of perforations which is subsequently located between and in parallel offset relation to the pair of parallel lines of perforations in order to define a plurality of weak hinges connecting the adjacent plies to each other. In either of the latter two embodiments, the parallel lines of perforations are closely spaced relative to each other to form the weak hinge connection.

The fabrication of the latter embodiments is similar to the above described method of forming the mailer assembly except for the positioning of the second line of perforations or the second and third lines of perforations.

The continuous mailer assembly may also have more than one insert ply between the front and back plies.

The formed assemblies can be folded at those places where the adjacent sections of a web are unconnected to each other (or connected via a weak hinge connection) into a zig-zag manner to form a stack. When so folded, each layer of the stack may have two or more mailer units therein. In such cases, only those sections of a ply where folding is to occur need be unconnected or connected via a weak hinge.

When the mailer assembly is unfolded from a stacked array, for example, for feeding into an automatic processing machine, no "tenting" occurs between the individual units of the assembly. This results because the back plies (or the front plies) are either completely severed from each other or are connected by a weak hinge connection which does not interfere with the hinging of the front plies (or back plies).

As with known mailer assemblies, the assembly can be provided with an overlying ply which, after feeding through an automatic processing machine, can be retained for audit purposes while the mailer units are mailed. Further, each of the webs may be provided with control pin holes along the side edges in order to facilitate processing in automatic equipment.

These and other objects and advantages of the invention will become more apparent from the following detailed description taken in conjunction with the accompanying drawings wherein:

FIG. 2 illustrates a top view of two adjacent units of a continuous mailer assembly according to the invention;

FIG. 3 illustrates a fragmentary view of a portion of the mailer assembly of FIG. 2;

FIG. 6 illustrates a view similar to FIG. 3 of a detail of a modified mailer assembly according to the invention; and FIG. 7 illustrates a view similar to FIG. 3 of a detail of a further modified mailer assembly according to the invention.

Figure 4:
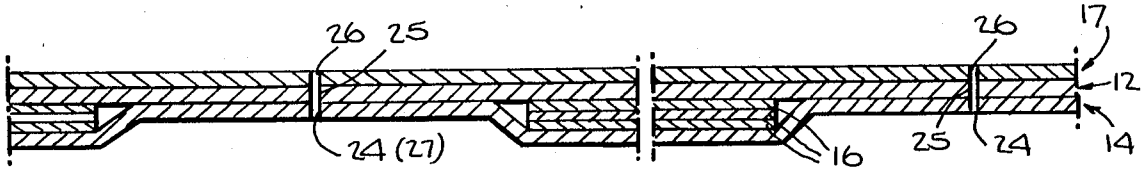
FIG. 4 illustrates an enlarged cross-sectional view taken on line 4—4 of FIG. 1.
Figure 1:
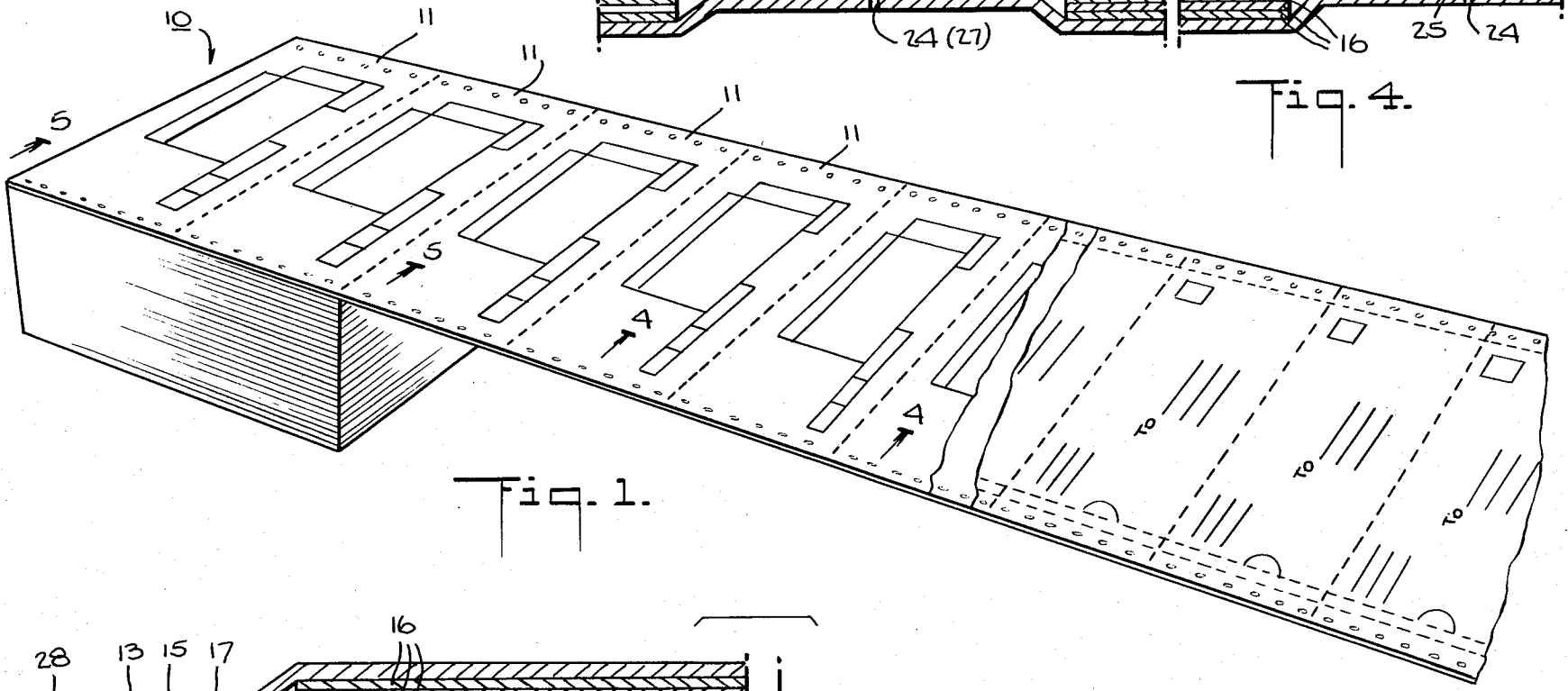
FIG. 1 illustrates a continuous mailer assembly constructed in acoordance with the invention.

Referring to FIG. 1, the continuous mailer assembly 10 is formed of a plurality of interconnected mailer units 11 which can be folded in a zig-zag manner into a stacked array. As shown, each layer of the stacked array has two mailer units 11 disposed in coplanar relation.

Referring to FIG. 3, the mailer assembly 10 is fabricated from continuous webs of paper or the like. One web 12 serves to form a series of front plies 13, a second web 14 forms a series of back plies 15, one or more webs (not shown) are processed to form a plurality (e.g. three) of insert plies 16 and another web 17 forms a cover sheet.

As shown in FIG. 3, each mailer unit 11 includes a front ply 13, a back ply 15 and three insert plies 16 between the front and back plies 13, 15. In addition, suitable longitudinal lines 18 and transverse lines 19 of adhesive are provided between the front and back plies 13, 15 to adhesively secure the plies 13, 15 together to define an envelope. These lines of adhesive 18, 19 also serve to frame the insert plies 16 within the envelope defined by the front and back ply 13, 15 of each unit 11.

In addition, each of the webs 12, 14, 17 is provided with a longitudinal line of weakening or perforations 20, 21, 22 on each side in known manner so as to provide removable strips in which pin control holes 23 are respectively located in known manner The mailer units 11 are connected to each other via lines of perforations in the respective front and back plies 13, 15. For example, the back plies 15 in each layer are separated by a single line of transverse perforations 24 and the front plies 13 are separated by a single line of perforations 25. The cover sheet 17 is similarly perforated at intervals with a single line of transverse perforations 26.

The mailers 11 in each layer are also separated from the adjacent mailer 11 of an adjacent layer in a manner so as to prevent tenting from occurring. As shown in FIG. 3, the back plies 15 of the adjacent stack layers are unconnected to each other while the front plies 13 remain connected in an interrupted manner. To this end, the back plies 15 are separated by two transverse lines of perforations 24, 27. The second line of perforations 27 is located in an aligned and offset manner to the first line of perforations 24 so as to completely sever the back plies 15 from each other while retaining the back plies 15 contiguous to each other. The front plies 13 are separated by the single line of perforations 25 with small hinges 28 being formed between the perforations.

The complete severing of the back plies 15 from each other permits folding of the mailer assembly 10 about the hinges 28 of the front plies 13. Hence, subsequent unfolding of the assembly 10 from the stacked array occurs without any tenting occurring at the fold lines.

In order to fabricate the mailer assembly 10, the three paper webs 12, 14, 17 are generated to form the front plies 13, back plies 15 and cover sheet while three additional webs are generated to form the three insert plies 16. In this regard, the webs for forming the insert plies 16 are processed to define longitudinally spaced apart insert sections. Since this is a known technique, no further description is believed to be necessary.

After generating the various paper webs, the web 14 for forming the back plies 15 is perforated via a perforating blade (not shown) at longitudinally spaced apart intervals at which the mailer is to be folded in order to define the lines of perforations 27.

Next, the webs 12, 14, 17 are collated into superposed relation in known manner. At this time, the webs forming the front and back plies 13, 15 are adhered to each other via the lines of adhesive 18, 19. This also serves to encase the insert plies 16 within the envelopes defined by each respective front ply 13 and back ply 15. In addition, the web 17 forming the cover sheet is disposed in overlying relation to the front plies 13. Thereafter, all of the superimposed webs are simultaneously perforated at longitudinally spaced intervals to define a series of interconnected mailer units 11 with an overlying cover sheet 17. At this time, a single perforating blade is used to form the lines of perforations 24, 25, 26 in the webs defining the back plies 15, front plies 13 and cover sheet 17. The perforations 26 in the cover sheet 17 form small hinges 29 interconnecting the sections of the cover sheet 17.

The simultaneous perforation of all of the superimposed webs is carried out at intervals corresponding to the length of the mailer units 11. Further, the simultaneous perforating step is carried out so that the line of perforations 24 in the web 14 forming the back plies 15 is offset from the previously formed line of perforations 27 such that complete severing of the web 14 occurs along these lines 24, 27. The web 14 however remains affixed to the web 12 forming the front plies 13 via the lines of adhesive 18, 19.

The perforating blades (not shown) are of conventional construction and have, for example four or five teeth per inch with a gap between adjacent teeth of from 0.030 inch to 0.050 inch depending on the strength and type of paper being perforated.

The longitudinal lines of perforations 20, 21, 22 are formed on each side of the webs 12, 14, 17 in known manner before, after or during the transverse perforating of the webs.

After the perforating steps have been carried out, the mailer assembly 10 can then be folded into a stacked array as indicated in FIG. 1. Of note, the lines of perforations 27 are located at alternating lines of perforations 24.

Figure 5:
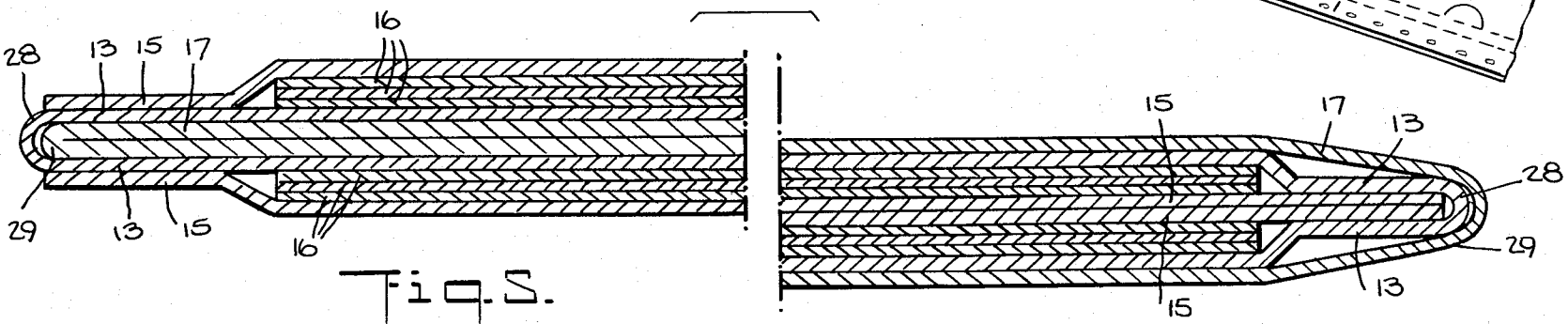
FIG. 5 illustrates a view taken on line 5—5 of FIG. 1.

Referring to FIG. 5, when the assembly 10 is folded into a stacked condition, two conditions occur as indicated to the left and to the right of FIG. 5. In the first instance, with the cover sheet sections facing each other in two adjacent layers, as shown on the left, the hinges 28, 29 between the respective front plies 13 and the cover sheet 17 permit folding. However, the free edges of the back plies 15 are disposed in spaced substantially parallel relationship.

When the mailer units 11 are disposed so that the back plies 15 face each other, the edges of the back plies 15 are in parallel relation as indicated on the right in FIG. 5. The hinges 28, 29 between the front plies 13 and the cover sheet sections then cover over the ends of the back plies 15.

As indicated, because the edges of the back plies 15 at the fold areas are not connected to each other, no restraint occurs against folding. Likewise, upon unfolding of the mailer units 11, there is no stressing which tends to create a "tent".

Referring to FIG. 6, wherein like reference characters indicate like parts as above, the back plies 15 can be connected to each other but via a weakened zone. To this end, the lines of perforations 24, 27 in the web 14 for the back plies 15 are located in parallel relation to each other to form a weak hinge connection therebetween which is characterized in being sufficiently weak to prevent tenting from occurring upon a subsequent folding and unfolding of the adjacent plies 15. As indicated, the longitudinal spacing between the respective lines 24, 27 is 1/32 inch from centerline-to-centerline.

When the mailer assembly 10 is folded such that the cover sheet sections face each other, the weak hinges between the back plies 15 are insufficient to impart a pre-stress in the folded assembly. Thus, upon unfolding, the weak hinge may either rupture or may be sufficiently weak to preclude a "tent" from occurring.

Referring to FIG. 7, wherein like reference characters indicate like parts as above, a weak zone may be defined between the back plies 15 by a pair of parallel lines 24' of perforations and a third line of perforations 27. In this case, the web 14 defining the back plies 15 is initially formed with a pair of parallel lines of perforations 24'. Thereafter, when all of the webs are being simultaneously perforated, the line of perforations 27 is located between the two lines of perforations 24' and in offset relation. In this way, a small hinge connection is formed between the plies 15. This hinge connection is similar to that of FIG. 6 and functions in a similar manner. As above, the spacing between the lines of perforations is 1/32 inch from center-line-to-centerline.

Of note, should the third line of perforations 27 be off-line a complete severing may occur across one of the other lines of perforations 24'. In any event, the zone between the lines of perforations 24' is sufficiently weakened so that the fibers of the paper plies easily tear or bend when the mailer assembly 10 is folded. The same occurs in the embodiment of FIG. 6.

As is known, the cover sheet 17 and front plies 13 can be provided with various preprinted boxes or other designated areas to receive information which is collated to similar boxes or areas on the insert plies 16. For example, billing data or like information can be typed onto the boxes of the cover sheet 17 for transfer onto an insert ply 16 in similarly disposed boxes. This information can be transferred by a suitable image transfer means on the back side of the front ply 13 and insert plies 16.

In use, the mailer assembly 10 can be unfolded from a stack and passed through suitable automatic machinery wherein information can be transferred onto the various plies. To this end, use is made of the pin control holes 23 for feeding the assembly 10 through the machinery. After the information has been affixed on the cover sheet 17, the cover sheet 17 can be removed and retained, for example, in an account file by the user. The remaining series of interconnected mailers 11 can then be broken apart and mailed separately. When received by an addressee a mailer 11 can be opened and the enclosed insert plies 16 removed for reading.

It is to be noted that the insert plies 16 can be disposed in place in various manners, for example, by tacking with suitable adhesive dots.

The invention thus provides a continuous mailer assembly which will not "tent" when unfolded from a stacked configuration, for example, for processing in automatic equipment.

The invention further provides a relatively simple method of forming a tentless continuous mailer assembly wherein existing equipment can be readily retrofitted to carry out the perforating operations.

Of note, although the mailing units 11 are described with the front plies 13 between the cover sheet 17 and back plies 15, the units 11 may also be used in reverse, i.e. with the "front" plies 13 serving as the back plies of the units 11.

What is claimed is:

1. A continuous mailer assembly comprising a plurality of interconnected units disposed in stacked array, each unit including a front ply, a back ply secured to said front ply to define an envelope and at least one insert ply between said front ply and said back ply;

one of said front ply and said back ply of one of said units being unconneted and contiguous with one ply of an adjacent unit and the other of said front ply and said back ply being connected with another ply of said adjacent unit in an interrupted manner.

2. A continuous mailer assembly comprising a plurality of interconnected units disposed in stacked array, each unit including a front ply, a back ply secured to said front ply to define an envelope and at least one insert ply between said front ply and said back ply;

one of said front ply and said back ply of one of said units being connected with one ply of an adjacent unit with a pair of parallel lines of perforations disposed in offset relation to each other to define a weak hinge connection sufficiently weakened to prevent tenting from occurring upon a subsequent folding and unfolding of said adjacent units and the other of said front ply and said back ply being connected with another ply of an adjacent unit in an interrupted manner.

3. A continuous tentless mailer assembly comprising a plurality of interconnected units disposed in layers in a stacked array, each said unit including a front ply, a back ply secured to said front ply to define an enclosed envelope, and at least one insert ply between said front ply and said back ply;

each said front ply of one of said layers being hingedly connected to an adjacent front ply of an adjacent layer along a line of perforations;

each said back ply of said one layer being hingedly connected to an adjacent back ply of said adjacent layer with a pair of parallel lines of perforations and a third line of perforations located between and in parallel offset relation to said pair of parallel lines of perforations defining a plurality of hinges connecting said adjacent back plies to each other.

4. An assembly as set forth in claim 3 wherein each said top ply, bottom ply and intermediate ply of each unit has a series of control line holes along two opposite edges thereof.

5. An assembly as set forth in claim 3 wherein said units are disposed in co-planar pairs in each layer and are folded in zig-zag manner to define a stack.

6. An assembly as set forth in claim 5 which comprises a plurality of spaced apart hinges integrally connected between and to said front ply of said one layer and said adjacent front ply of said adjacent layer.

7. An assembly as set forth in claim 3 wherein said pair of parallel lines of perforations define spaced apart connecting strips between said adjacent back plies and each said perforation of said third line of perforations extends through a respective one of said connecting strips.

8. A continuous tentless mailer assembly comprising a plurality of interconnected units disposed in layers in a stacked array, each said unit including a front ply, a back ply secured to said front ply to define an enclosed envelope, and at least one insert ply between said front ply and said back ply;

each said front ply of one of said layers being hingedly connected to an adjacent front ply of an adjacent layer along a line of perforations;

each said insert ply being unconnected with an adjacent insert ply; and each said back ply of said one layer being hingedly connected to an adjacent back ply of said adjacent layer with a pair of parallel lines of perforations disposed in offset relation to each other defining a plurality of hinges connecting said adjacent back plies to each other.

9. An assembly as set forth in claim 8 wherein each layer includes a plurality of said units disposed in co-planar relation.

* * * * *